US008186459B1

(12) United States Patent
Mazorow

(10) Patent No.: US 8,186,459 B1
(45) Date of Patent: May 29, 2012

(54) FLEXIBLE HOSE WITH THRUSTERS AND SHUT-OFF VALVE FOR HORIZONTAL WELL DRILLING

(75) Inventor: Henry B. Mazorow, Lorain, OH (US)

(73) Assignee: Horizontal Expansion Tech, LLC, Lorain, OH (US)

( * ) Notice: Subject to any disclaimer, the term of this patent is extended or adjusted under 35 U.S.C. 154(b) by 321 days.

(21) Appl. No.: 12/488,709

(22) Filed: Jun. 22, 2009

Related U.S. Application Data

(60) Provisional application No. 61/074,749, filed on Jun. 23, 2008.

(51) Int. Cl.
*E21B 7/18* (2006.01)
*E21B 17/20* (2006.01)

(52) U.S. Cl. ..... 175/67; 175/424

(58) Field of Classification Search ..... 175/67, 175/65, 424
See application file for complete search history.

(56) References Cited

U.S. PATENT DOCUMENTS

| | | | | |
|---|---|---|---|---|
| 1,904,819 A | | 4/1933 | Blodgett | |
| 2,383,496 A | * | 8/1945 | Nebolsine | 175/62 |
| 2,521,976 A | | 9/1950 | Hays | |
| 2,765,146 A | * | 10/1956 | Williams, Jr. | 175/317 |
| 3,566,980 A | * | 3/1971 | Scroggins | 175/65 |
| 4,007,797 A | | 2/1977 | Jeter | |
| 4,431,069 A | | 2/1984 | Dickinson, III et al. | |
| 4,474,252 A | | 10/1984 | Thompson | |
| 4,497,381 A | | 2/1985 | Dickinson, III et al. | |
| 4,501,337 A | | 2/1985 | Dickinson, III et al. | |
| 4,527,639 A | | 7/1985 | Dickinson, III et al. | |
| 4,637,479 A | | 1/1987 | Leising | |
| 4,640,362 A | | 2/1987 | Schellstede | |
| 4,646,831 A | | 3/1987 | Marsh et al. | |
| 4,658,916 A | | 4/1987 | Bond | |
| 4,735,501 A | | 4/1988 | Ginsburgh et al. | |
| 4,763,734 A | | 8/1988 | Dickinson et al. | |
| 4,786,874 A | | 11/1988 | Grosso et al. | |
| 4,842,487 A | | 6/1989 | Buckman et al. | |
| 4,850,440 A | * | 7/1989 | Smet | 175/67 |
| 4,930,586 A | | 6/1990 | Turin | |
| 4,947,944 A | | 8/1990 | Coltman et al. | |

(Continued)

FOREIGN PATENT DOCUMENTS

GB 2284837 A 6/1995

(Continued)

OTHER PUBLICATIONS

Omrćen et al., "Application and results of Petro Jet® multilateral drilling in Croatia," PJMLS: Oct. 2001, Int'l Conf., pp. 1-22.

*Primary Examiner* — Kenneth L Thompson
(74) *Attorney, Agent, or Firm* — Pearne & Gordon LLP

(57) ABSTRACT

A flexible hose and a method of well drilling are provided herein. In embodiments, the hose includes a forward end, a rearward end, a thruster port and a shut-off valve. The rearward end is configured to be in fluid communication with a source of high pressure drilling fluid. The thruster port is located upstream of the forward end. The thruster port is configured to emit drilling fluid in a substantially rearward direction. The shut-off valve is located between the forward end and the thruster port and is configured to shut off flow of drilling fluid downstream.

20 Claims, 5 Drawing Sheets

U.S. PATENT DOCUMENTS

| | | | |
|---|---|---|---|
| 4,991,667 | A | 2/1991 | Wilkes, Jr. et al. |
| 5,006,046 | A | 4/1991 | Buckman et al. |
| 5,148,877 | A | 9/1992 | MacGregor |
| 5,165,491 | A | 11/1992 | Wilson |
| 5,194,859 | A | 3/1993 | Warren |
| 5,210,533 | A | 5/1993 | Summers et al. |
| 5,255,750 | A | 10/1993 | Wilkes, Jr. et al. |
| 5,318,121 | A | 6/1994 | Brockman et al. |
| 5,363,927 | A | 11/1994 | Frank |
| 5,394,951 | A | 3/1995 | Pringle et al. |
| 5,396,966 | A | 3/1995 | Roos, Jr. et al. |
| 5,402,855 | A | 4/1995 | Gondouin |
| 5,410,303 | A | 4/1995 | Comeau et al. |
| 5,413,184 | A | 5/1995 | Landers |
| 5,439,066 | A | 8/1995 | Gipson |
| 5,458,209 | A | 10/1995 | Hayes et al. |
| 5,528,566 | A | 6/1996 | McGee et al. |
| 5,553,680 | A | 9/1996 | Hathaway |
| RE35,386 | E | 12/1996 | Wu et al. |
| 5,626,508 | A | 5/1997 | Rankin et al. |
| 5,687,806 | A | 11/1997 | Sallwasser et al. |
| 5,853,056 | A | 12/1998 | Landers |
| 5,892,460 | A | 4/1999 | Jerabek et al. |
| 5,899,958 | A | 5/1999 | Dowell et al. |
| 5,934,390 | A | 8/1999 | Uthe |
| 5,987,385 | A | 11/1999 | Varsamis et al. |
| 6,089,332 | A | 7/2000 | Barr et al. |
| 6,109,370 | A | 8/2000 | Gray |
| 6,125,949 | A | 10/2000 | Landers |
| 6,257,353 | B1 | 7/2001 | Belew et al. |
| 6,263,984 | B1 | 7/2001 | Buckman, Sr. |
| 6,352,109 | B1 | 3/2002 | Buckman, Sr. |
| 6,470,978 | B2 | 10/2002 | Trueman et al. |
| 6,488,082 | B2 | 12/2002 | Echols et al. |
| 6,530,439 | B2 | 3/2003 | Mazorow |
| 6,578,636 | B2 | 6/2003 | Mazorow et al. |
| 6,668,948 | B2 | 12/2003 | Buckman, Sr. et al. |
| 6,889,781 | B2 | 5/2005 | Mazorow |
| 6,964,303 | B2 | 11/2005 | Mazorow et al. |
| 7,357,182 | B2 | 4/2008 | Hunt et al. |
| 2001/0045300 | A1 | 11/2001 | Fincher et al. |
| 2005/0103528 | A1 | 5/2005 | Mazorow et al. |
| 2006/0278393 | A1 | 12/2006 | Hunt et al. |

FOREIGN PATENT DOCUMENTS

| | | | |
|---|---|---|---|
| WO | 97/21900 | A1 | 6/1997 |
| WO | 97/49889 | A1 | 12/1997 |
| WO | 99/66168 | A1 | 12/1999 |

* cited by examiner

FLEXIBLE HOSE WITH THRUSTERS AND SHUT-OFF VALVE FOR HORIZONTAL WELL DRILLING

CROSS-REFERENCE TO RELATED APPLICATIONS

This application claims the benefit of U.S. Provisional Application No. 61/074,749, filed Jun. 23, 2008, the entire disclosure of which is hereby incorporated herein by reference.

FIELD OF THE INVENTION

The present invention relates generally to horizontal well drilling, and more particularly, to a flexible hose equipped with a shut-off valve.

BACKGROUND OF THE INVENTION

In the process of drilling for hydrocarbons such as oil and natural gas, vertical wells have been used most often in the past. Those wells will produce for a given amount of time, then begin to dry up. At that point, it is advantageous to drill out horizontally from the vertical well in order to try and increase production of, for example, crude oil.

There have been several attempts to find an economically viable and reliable system for drilling into the untapped pay zones adjacent an existing vertical well. Horizontal drilling has been proposed as an alternative and has been described in U.S. Pat. Nos. 5,853,056, 5,413,184, 5,934,390, 5,553,680, 5,165,491, 5,458,209, 5,210,533, 5,194,859, 5,439,066, 5,148,877, 5,987,385, 5,899,958, 5,892,460, 5,528,566, 4,947,944, 4,646,831, 4,786,874, 5,410,303, 5,318,121, 4,007,797, 5,687,806, 4,640,362, 5,394,951, 1,904,819, 2,521,976 and Re. 35,386, the contents of all of which are incorporated herein by reference.

U.S. Pat. No. 5,413,184 describes a method of horizontal drilling which utilizes a flexible hose and a high pressure nozzle blaster to bore into the earth's strata at significant depths, such as 4000 feet. The nozzle uses high pressure water to clear a path through the strata. The nozzle is advanced through the strata by applying weight to the hose, i.e., slacking off the tension in the vertical portion of the hose. Essentially, the weight of the 4000 feet of hose above the nozzle is used to apply pressure to the nozzle, thus forcing it along the horizontal path. While this method is effective at significant depths due to the large amount of weight available, it is less effective at shallower depths. At shallow depths, there simply is not enough weight available to supply sufficient force to advance the nozzle blaster through the strata. Thus, there is a need for an apparatus that will effectively advance a drilling tool such as a nozzle blaster horizontally through the earth's strata for horizontal drilling at shallow depths. Moreover, as horizontal or lateral hoses extend further from the bore hole, removal of cuttings by using sequential thrusters with the ability to shut off unnecessary jets is desired so that more fluid is directed at desired thrusters and volume of fluid is increased for cleaning purposes. This arrangement can also be used for cleaning obstructed pipes such as those in power plants.

BRIEF SUMMARY OF THE INVENTION

In one embodiment, a flexible hose is provided and comprises a forward end, a rearward end, a thruster port, and a shut-off valve. Said rearward end is configured to be in fluid communication with a source of high pressure drilling fluid.

Said thruster port is located upstream of said forward end. Said thruster port is configured to emit drilling fluid in a substantially rearward direction. Said shut-off valve is located between said forward end and said thruster port, and is configured to shut off flow of drilling fluid downstream.

In a further embodiment, a flexible hose is provided and comprises a forward end, a rearward end, a nozzle blaster, a shut-off valve. Said rearward end is configured to be in fluid communication with a source of high pressure drilling fluid. Said nozzle blaster is located at said forward end of said hose and comprises a front portion and a rear portion. Said front portion comprises a set of nozzle holes. Said rear portion comprises a set of thruster ports. Said nozzle holes are configured to emit drilling fluid in a substantially forward direction. Said thruster ports are configured to emit drilling fluid in a substantially rearward direction. Said shut-off valve is located between said front portion and said rear portion and is configured to shut off flow of drilling fluid downstream.

A method of well drilling is also provided. A flexible hose is advanced through a well bore. The hose comprises a forward end, a rearward end, a thruster port and a shut-off valve. Said rearward end is configured to be in fluid communication with a source of high pressure drilling fluid. Said thruster port is located upstream of said forward end and is configured to emit drilling fluid in a substantially rearward direction. Said shut-off valve is located between said forward end and said thruster port. Said shut-off valve is closed to prevent drilling fluid from flowing downstream of said shut-off valve. Said shut-off valve is opened to allow drilling fluid to flow downstream.

A method of well drilling is also provided. A flexible hose is advanced through a well bore. Said hose comprises a forward end and a rearward end. Said rearward end is configured to be in fluid communication with a source of high pressure drilling fluid. A thruster port is located upstream of said forward end and is configured to emit drilling fluid in a substantially rearward direction. A shut-off valve is located between said forward end and said thruster port. Said hose further comprises a nozzle blaster located at said forward end of said hose and comprising a set of nozzle holes. Said nozzle holes are configured to emit drilling fluid in a substantially forward direction so as to cut through earth strata. Said thruster port comprises a shutter configured to adjust said thruster port between an open state and a closed state. Earth strata are cut through using said nozzle holes with said thruster port in a closed state. Said shut-off valve is closed to prevent drilling fluid from flowing downstream of said shut-off valve. Said thruster port is opened to move cut earth toward said rearward end.

DESCRIPTION OF EXAMPLES OF EMBODIMENTS

In the description that follows, when a preferred range such as 5 to 25 (or 5-25) is given, this means preferably at least 5, and separately and independently, preferably not more than 25. As used herein, the following terms have the following meanings "gal/min" means gallons per minute and "psi" means pounds per square inch. Also as used herein, when referring to a tool used downhole in a well, such as a well perforating tool or a flexible hose assembly, the rearward end of the tool is the end nearest the earth surface when being used, and the forward end of the tool is the end farthest from the earth surface when being use, i.e., the forward end is the end inserted first into the well.

The disclosed embodiments can be used with respect to oil wells, natural gas wells, water wells, solution mining wells, and other wells. In embodiments, a flexible hose assembly includes a flexible hose with thrusters and a nozzle blaster for horizontal well drilling. The hose assembly is fed down into the bore of an existing vertical well to a specified depth, at which point it is redirected along a horizontal direction, substantially perpendicular to the vertical well. Preferably, the hose assembly is fed into the well by a coil tubing injector as known in the art. Redirection of the hose assembly is accomplished via an elbow or shoe in upset tubing as is known in the art, less preferably via some other known or suitable means.

The hose may be supplied with a plurality of thruster couplings disposed along the length of the hose. Each coupling contains one or more thrusters, each thruster comprising a hole through the coupling wall, to allow the passage of drilling fluid, such as water, therethrough. The holes are oriented in a substantially rearward direction about the circumference of the coupling such that high pressure water exits the holes at a substantially rearward angle, and enters the horizontal bore in a direction sufficient to impinge upon the walls of the bore, thus thrusting the hose (and thereby the nozzle blaster) forward through the bore.

Figure 4:
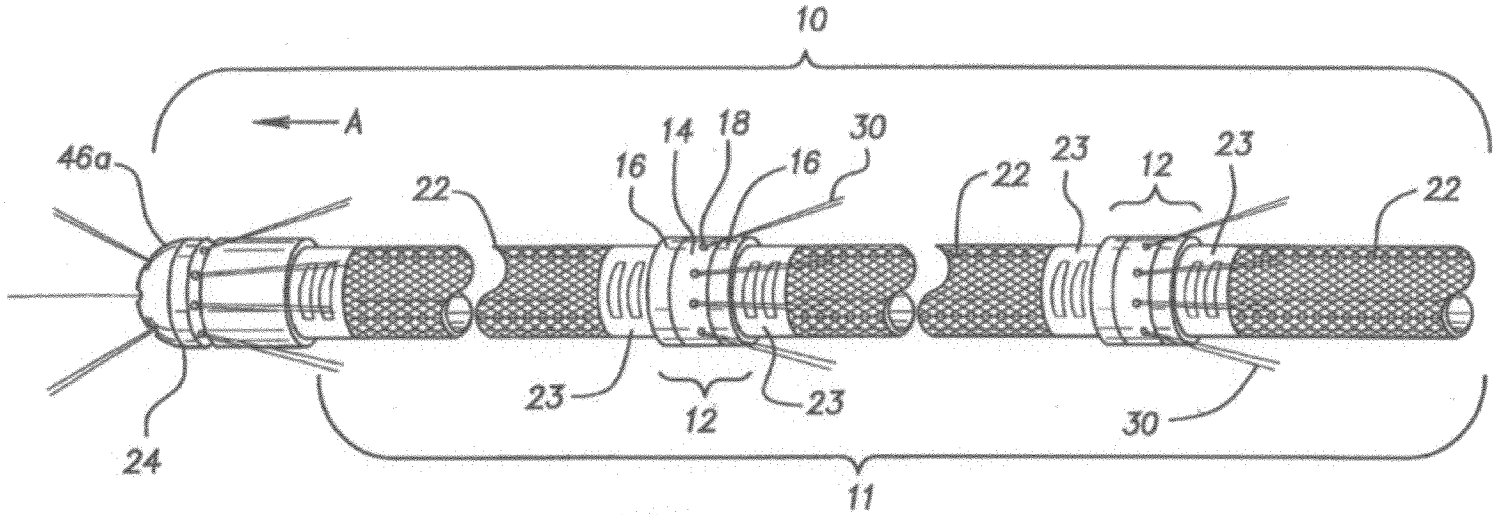
FIG. 4 is a perspective view of a flexible hose having thruster couplings as herein described.

With reference to FIG. 4, there is shown generally a flexible hose assembly 10, which preferably comprises a nozzle blaster 24 and a flexible hose 11. Flexible hose 11 preferably has a plurality of flexible hose sections 22, a pair of pressure fittings 23 attached to the ends of each hose section 22, and a plurality of thruster couplings 12, each of which joins a pair of adjacent pressure fittings 23. Hose assembly 10 preferably comprises a nozzle blaster 24 at one end and is connected to a source (not shown) of high pressure fluid, preferably an aqueous liquid, preferably water, less preferably some other liquid, at its other end. Couplings 12 are spaced at least, or not more than, 5, 10, 20, 30, 40, 50, 60, 70, 80, 90 or 100 feet apart from each other in hose 11. The total hose length is preferably at least or not more than 100 or 200 or 400 or 600 or 700 or 800 or 900 or 1000 or 1200 or 1400 or 1600 or 1800 or 2000 feet. Hose sections 22 are preferably flexible hydraulic hose known in the art, comprising a steel braided rubber-Teflon (polytetrafluoroethylene) mesh, preferably rated to withstand at least 5,000, preferably 10,000, preferably 15,000, psi water pressure. High pressure water is preferably supplied at least 2,000, 5,000, 10,000, or 15,000 psi, or at 5,000 to 10,000 to 15,000 psi. When used to drill horizontally from a vertical well, the hose extends about or at least or not more than 7, 10, 50, 100, 200, 250, 300, 350, 400, 500 or, most preferably, 440 feet horizontally from the original vertical well.

Figure 1:
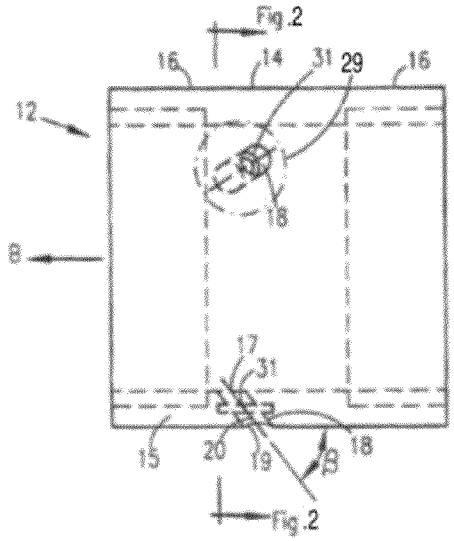
FIG. 1 is a side view of a preferred thruster coupling as herein described.

As illustrated in FIG. 1, thruster coupling 12 comprises a coupling or fitting, preferably made from metal, preferably steel, most preferably stainless steel, less preferably aluminum. Less preferably, coupling 12 is a fitting made from plastic, thermoset, or polymeric material, able to withstand 5,000 to 10,000 to 15,000 psi of water pressure. Still less preferably, coupling 12 is a fitting made from ceramic material. Coupling 12 has two threaded end sections 16 and a middle section 14. Preferably, end sections 16 and middle section 14 are formed integrally as a single solid part or fitting. Threaded sections 16 are female-threaded, so as to receive male-threaded pressure fittings 23 which are attached to, preferably crimped within the ends of, hose sections 22 (FIG. 4). Each fitting 23 has a threaded portion and a crimping portion which can be a unitary or integral piece, or a plurality of pieces joined together as known in the art. Alternatively, the threaded connections may be reversed; i.e. with male-threaded end sections 16 adapted to mate with female-threaded pressure fittings attached to hose sections 22. Less preferably, end sections 16 are adapted to mate with pressure fittings attached to the end of hose sections 22 by any known connecting means capable of providing a substantially water-tight connection at high pressure, e.g. 5,000-15,000 psi. Middle section 14 contains a plurality of holes or thruster ports 18 which pass through the thickness of wall 15 of coupling 12 to permit water to jet out. Coupling 12 preferably is short enough to allow hose 11 to traverse any bends or elbows in the upset tubing and any shoes or adapters used therewith. Therefore, coupling 12 is formed as short as possible, preferably having a length of less than about 3, 2, or 1.5 inches, more preferably about 1 inch or less than 1 inch. Hose 11 (and therefore couplings 12 and hose sections 22) preferably have an outer diameter of about 0.25 to about 1.25 inches, more preferably about 0.375 to about 0.5 inches, and an inner diameter preferably of about 0.125 inches. Couplings 12 have a wall thickness of preferably about 0.025-0.25, more preferably about 0.04-0.1, inches.

Figure 6:
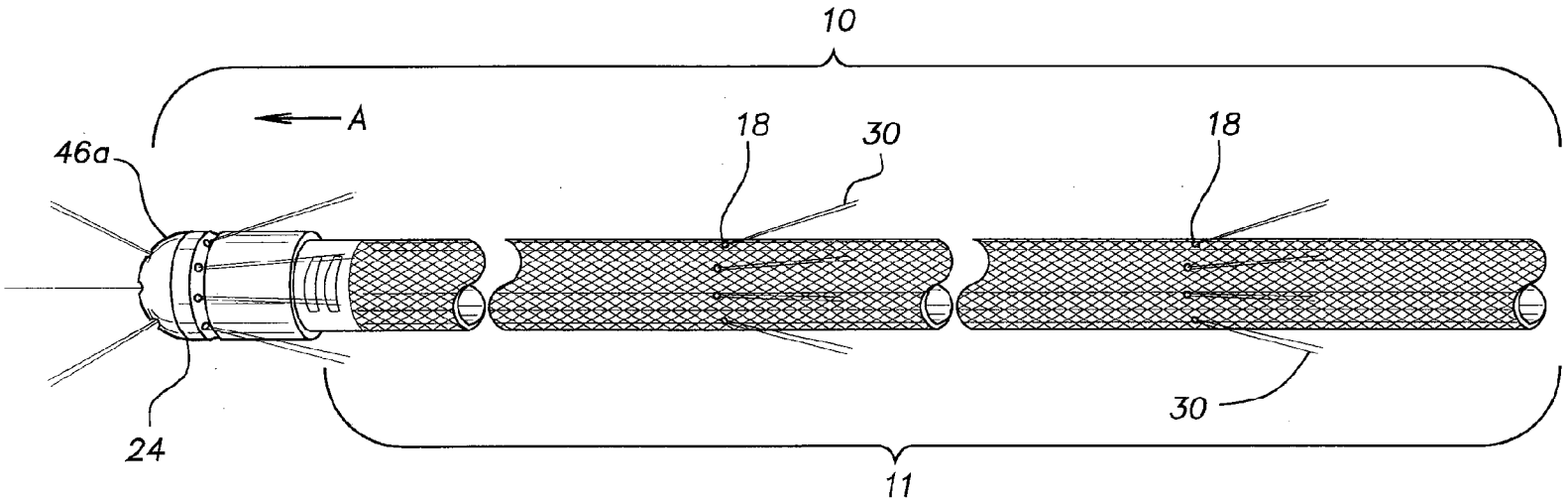
FIG. 6 is a perspective view of a flexible hose having thruster ports provided directly in the sidewall according to an embodiment.

Optionally, hose 11 is provided with couplings 12 formed integrally therewith, or with the thruster ports 18 disposed directly in the sidewall of a contiguous, unitary, non-sectioned hose at spaced intervals along its length (FIG. 6). A hose so comprised obviates the need of threaded connections or other connecting means as described above.

As shown in FIG. 1, the thruster ports 18 have hole axes 20 which form an angle $\beta$ with the longitudinal axis of the coupling 12. Angle $\beta$ is preferably 10° to 80°, more preferably 15° to 70°, more preferably 20° to 60°, more preferably 25° to 50°, more preferably 30° to 45°, more preferably 40° to 45°, more preferably about 45°. The thruster ports 18 are also oriented such that water passing through them exits the coupling 12 in a substantially rearward direction; i.e. in a direction that is upstream from the location of the hole, being substantially opposite the desired direction of travel of the nozzle blaster (The desired direction of travel of the nozzle blaster is indicated by arrow A in FIGS. 1 and 4). In this manner, high-pressure water jets 30 emerging from thruster ports 18 impart drilling force to the nozzle blaster, thus forcing the nozzle blaster forward into the earth strata (see FIG. 4). As shown in FIGS. 1 and 4, each thruster port 18 is adapted to direct pressurized aqueous liquid in a direction forming an angle (preferably less than 80°) with the longitudinal axis of the hose in an upstream direction from the location of the hole.

Figure 2:
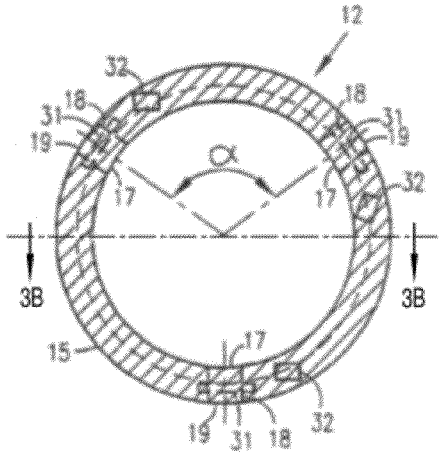
FIG. 2 is a cross-sectional view of a preferred thruster coupling taken along line 2-2 in FIG. 1.
Figure 3A:
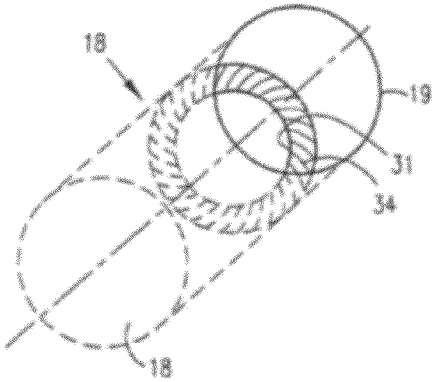
FIG. 3A is a close-up view of an adjustable thruster port indicated at broken circle 29 in FIG. 1.
Figure 3B:
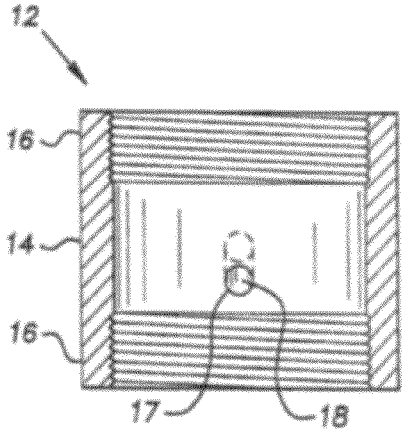
FIG. 3B is a longitudinal cross-sectional view of a preferred thruster coupling taken along line 3B-3B in FIG. 2.

As illustrated in FIG. 2, a plurality of thruster ports 18 are disposed in wall 15 around the circumference of coupling 12.

There are 2 to 6 or 8 holes, more preferably 3 to 5 holes, more preferably 3 to 4 holes. The thruster ports 18 are spaced uniformly about the circumference of coupling 12, thus forming an angle α between them. Angle α will depend upon the number of thruster ports 18, and thus will be preferably from 45° or 60° to 180°, more preferably 72° to 120°, more preferably 90° to 120°. The thruster ports 18 are preferably about 0.010 to 0.017 inches, more preferably 0.012 to 0.016 inches, more preferably 0.014 to 0.015 inches in diameter.

As best seen in FIGS. 1 and 2, the thruster ports 18 are formed in the wall 15 of coupling 12, extending in a substantially rearward direction relative to direction A, connecting inner opening 17 at the inner surface of wall 15 with outer opening 19 at the outer surface of wall 15. The number of couplings 12, as well as the number and size of the thruster ports 18 depends upon the desired water pressure and water flow rate. If a water source of only moderate delivery pressure is available, e.g. 5,000-7,000 psi, then relatively fewer couplings 12 and the thruster ports 18, as well as possibly smaller diameter thruster ports 18 should be used. However, if higher pressure water is supplied initially, e.g. 10,000-15,000 psi, then more couplings 12 and thruster ports 18 can be utilized. The number of couplings 12 and thruster ports 18, the diameter of thruster ports 18, and the initial water pressure and flow rate can all be adjusted to achieve water flow rates through nozzle blaster 24 of 1.5-5, more preferably 2-3.5, more preferably 2.5-3, gal/min.

As shown in FIGS. 1-3B, the thruster couplings 12 and thruster ports 18 may be made adjustable using a shutter 31, shown inside a dotted circle 29. The shutter is preferably an iris as shown in FIG. 1, and shown close-up in FIG. 3A. The shutter 31 is actuated by a servo controller 32 (picture schematically in the figures) which is controlled by an operator at the surface via wireline, radio signal or any other suitable or conventional means. The servo controller 32 is preferably provided in the sidewall of the coupling 12 as shown in FIG. 2, or is mounted on the inner wall surface of the coupling 12. The servo controller 32 has a small stepping motor to control or actuate the shutter 31 to thereby regulate the diameter or area of the opening 34 for the thruster port 18. A fully open shutter 31 result in the maximum possible thrust from the associated thruster port 18 because the maximum area is available for the expulsion of high pressure fluid. An operator can narrow the opening 34 by closing the shutter 31 to regulate the amount of thrust imparted to the hose assembly by the associated thruster port 18. The smaller the diameter of the opening 34, the less thrust is provided by the thruster port 18. Although an iris is shown, it will be understood that other mechanisms can be provided for the shutter 31 which are conventional or which would be recognized by a person of ordinary skill in the art; e.g. sliding shutter, flap, etc. The servo controller 32 is preferably a conventional servo controller having a servo or stepping motor that is controlled in a conventional manner. Servo controllers are generally known or conventional in the art. Additional details of adjustable thruster ports are disclosed in U.S. Pat. No. 7,357,182, which is incorporated herein by reference.

Figure 5B:
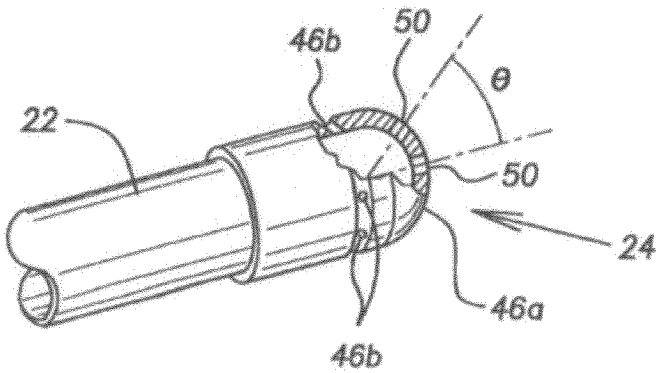
FIG. 5B is an alternate perspective view of a nozzle blaster.
Figure 5A:
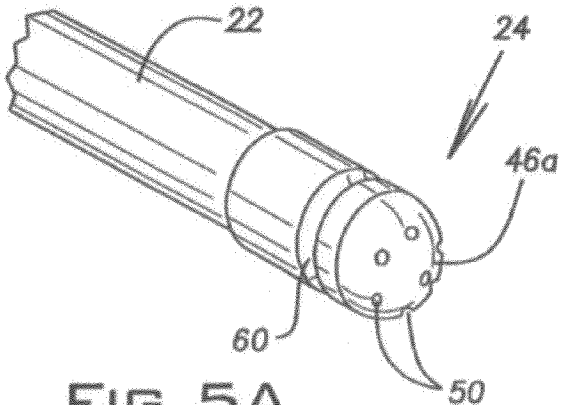
FIG. 5A is a perspective view of a nozzle blaster.

Nozzle blaster 24 is of any type known in the art, for example, the type shown in FIGS. 5A-5B. Nozzle blaster 24 comprises a plurality of nozzle holes 50 disposed about a front portion 46*a* which preferably has a substantially domed shape. Nozzle holes 50 are positioned in a substantially forward direction so as to form angle 8 with the longitudinal axis of nozzle blaster 24. Angle 8 is 10°-30°, more preferably 15°-25°, more preferably about 20°. Nozzle blaster 24 also comprises a plurality of holes 46*b*, which are oriented in a reverse or substantially rearward direction on a rear portion 60 of nozzle blaster 24, the direction and diameter of holes 46*b* being similar to that of thruster ports 18 disposed around couplings 12. Holes 46*b* serve a similar function as thruster ports 18 to impart forward drilling force to nozzle blaster 24. Optionally, front portion 46*a* is rotatably coupled to rear portion 60, with nozzle holes 50 oriented at an angle such that exiting high-pressure water imparts rotational momentum to front portion 46*a*, thus causing front portion 46*a* to rotate while drilling. Rear portion 60 is either fixed with respect to hose 11, unable to rotate, or is rotatably coupled to hose 11, thus allowing rear portion 60 to rotate independently of hose 11 and front portion 46*a*. In this embodiment, holes 46*b* are oriented at an angle effective to impart rotational momentum to rear portion 60 upon exit of high-pressure water, thus causing rear portion 60 to rotate while drilling. Nozzle holes 50 and holes 46*b* can be oriented such that front and rear portions (46*a* and 60 respectively) rotate in the same or opposite directions during drilling. The holes 46*b* may also be configured with the shutters 31 as described above.

Thruster ports 18 and 46*b* are oriented in a reverse direction relative to forward direction A (FIGS. 1 and 4) in order to help thrust the nozzle blaster along the bore. High pressure water is propelled through ports 18 and 46*b*, forming high pressure water jets 30 which impinge on the walls of the bore at such an angle as to help force the nozzle blaster forward by imparting drilling force to the nozzle blaster 24. Thus, a hose having thrusters has its greatest utility at shallow depths, where the length (and thereby the weight) of flexible hose in the vertical well is generally insufficient to supply adequate drilling force to the nozzle blaster 24 to propel it forward while drilling. As such, such a hose is preferably used at depths of at least, or not more than, 50, 100, 200, 300, 400, 500, 600, 700, 800, 900, or 1000 feet.

The thruster ports 18 and 46*b* also aid in keeping the bore clear behind nozzle blaster 24. Specifically, as hose assembly 10 is withdrawn from the bore, high pressure water or aqueous liquid forced through the ports 18 cleans and reams the bore by clearing away any sand and dirt that has gathered behind nozzle blaster 24, as well as smoothing the wall of the freshly drilled bore. Preferably, hose assembly 10 is withdrawn from the bore by a coil tubing injector as known in the art, less preferably by some other known withdrawing means.

Figure 7:
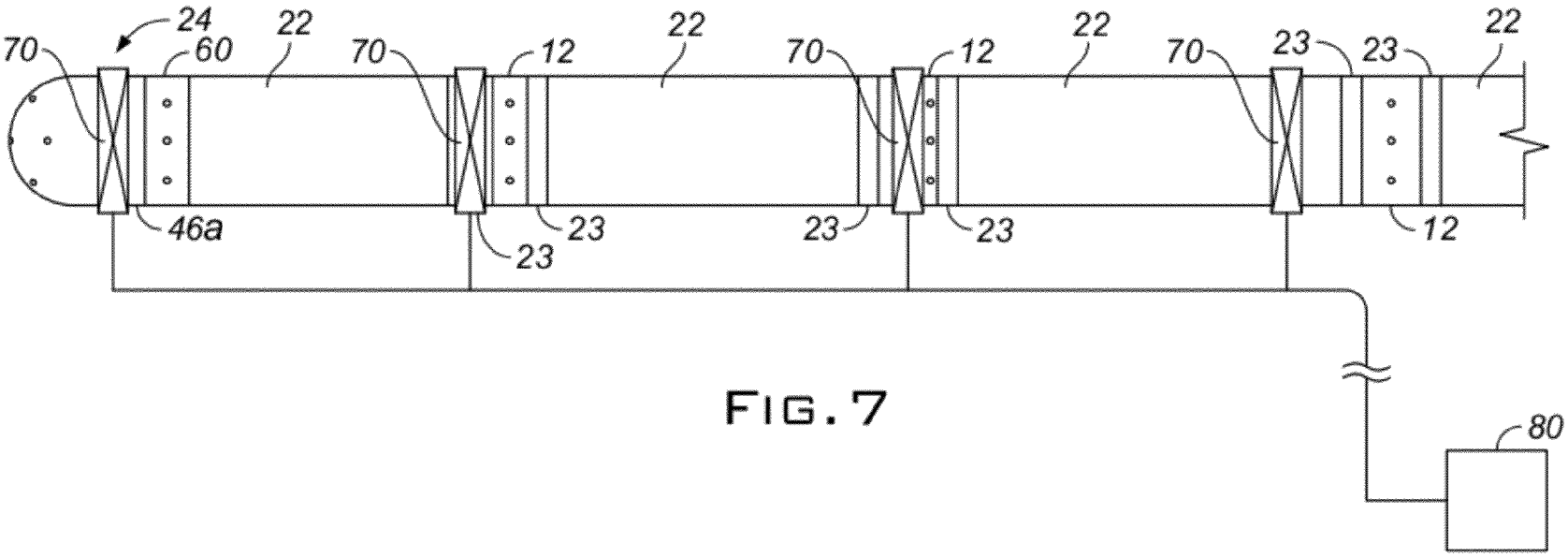
FIG. 7 is a schematic view of a flexible hose incorporating shut-off valves as herein described.

As shown schematically in FIG. 7, embodiments may incorporate a shut-off valve 70 located at one predetermined location or a plurality of shut-off valves 70 located at equal or unequal distances or intervals from one another along the length of the hose 11, such as axially along the hose 11, to limit the reach of water flow in the hose 11 and thereby selectively control or shut off the water flow through selected one of the thruster ports 18 and 46*b*, and the nozzle holes 50. In particular, the shut-off valve 70 may be located between the thruster ports 18 of one thruster coupling 12 and the thruster ports 18 of an adjacent thruster coupling 12 along the hose 11. As an alternative or in addition, a shut-off valve 70 may be located between the thruster ports 46*b* of the nozzle blaster 24 and the thruster ports 18 of the closest thruster coupling 12. As an alternative or in addition, a shut-off valve 70 may be installed or disposed within the nozzle blaster 24 between the nozzle holes 50 and the thruster ports 46*b* with appropriate modification to the current embodiment of the nozzle blaster 24 so as to provide space for installation of the shut-off valve 70. Moreover, as shown in FIG. 7, the shut-off valve 70 may be integrated into the coupling 12, the pressure fitting 23, the hose section 22, the front portion 46*a*, or the rear portion 24.

Figure 8:
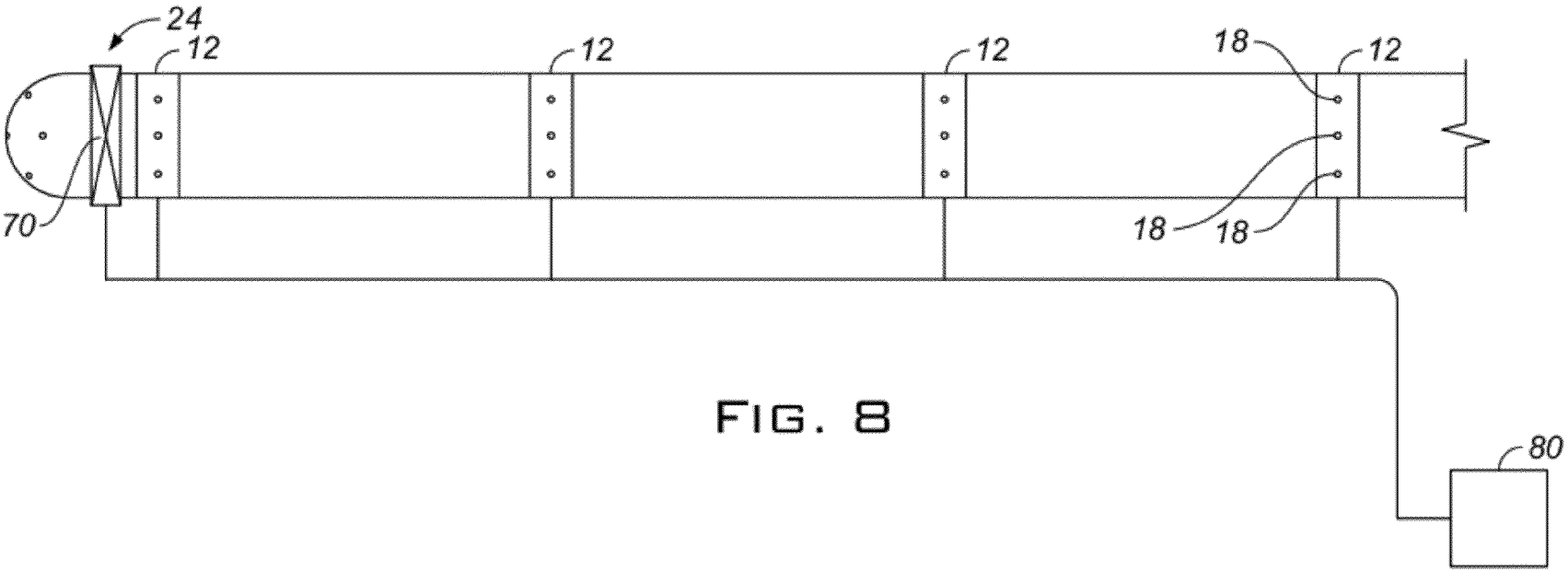
FIG. 8 is a schematic view of a flexible hose incorporating the shut-valve and the adjustable thruster ports.

Referring to FIGS. 7 and 8, the shut-off valves 70 and the shutters 31 can be configured to be controllable from a remote location, such as ground level, where an operator of the hose assembly 10 is present. Thus, the operator may be provided with a control panel including a set of switches, each corresponding to one of the shut-off valves 70 and the shutters 31. The switches may actuate the shut-off valves 70 and the shutters 31 through a controller or control means 80 such as an electric or electronic circuit, a hydraulic or pneumatic circuit to provide control via pressure, electromagnetic waves such as infrared or radio waves, or the like. For example, the shut-off valve 70 and the shutters 31 may be controlled using a remote control servo mechanism. The controls means 80 of FIGS. 7 and 8, shown in a schematic fashion, encompasses these various embodiments. The control means 80 may be housed within the hose assembly 10 to protect from wear and tear due to sand, dirt, oil, water or the like.

A shut-off valve 70 that is located upstream from the nozzle blaster 24 will prevent water from proceeding downstream toward the nozzle blaster 24 when the shut-off valve 70 is closed and will result in increased water flow for the thruster couplings 12 located upstream of the shut-off valve 70. If the hose 11 is configured with a plurality of interspersed shut-off valves 70, the actuation of one shut-off valve 70 may have a varying effect, for example, in terms of propelling force or cleaning efficacy, compared to the actuation of another shut-off valve 70, and the operator can alter the actuation of the shut-off valves 70 depending on the desired effect.

The shut-off valve 70 may be made of any material, such as metal, polymer, ceramic or the like, so long as it is capable to withstand the prevailing pressure of drilling fluid and may have any appropriate configuration as known in the art. Any suitable or conventional shut-off valve capable of withstanding the operating pressures described above, of being installed in-line with the hose 11, can be used. For example, a shut-off valve may be implemented as described in U.S. Pat. No. 6,089,332, which is hereby incorporated by reference.

The shutters 31 and the shut-off valves 70 located along the length of the hose 11 can be operated individually or in combination to control whether drilling fluid is emitted from the nozzle holes 50 and which of the thruster ports **46*b* and 18** emits drilling fluid.

The drilling fluid can be used to remove earth cuttings from the well bore. The hose assembly 10 can be operated such that earth cuttings are removed out of the well bore every time the hose 11 advances a given distance. Initially, high pressure drilling fluid is directed only to the nozzle holes 50 and drilling is done while the shutters 31 keep the thruster ports 18 and **46*b* closed. After the hose 11 advances a given distance (e.g., 2-3 inches), the shut-off valve 70 located immediately upstream the forward end of the hose (adjacent the nozzle blaster 24) is closed. Thereafter, the shutters 31 of the thruster ports 46*b* and 18 can be opened in a sequential order starting from the most downstream set of thruster ports to the most upstream set of thruster ports. One set of thruster ports 46*b* and 18 may be open at a time such that high pressure drilling fluid can be devoted to moving the cuttings upstream along a given segment of the hose 11. When drilling fluid is emitted from one set of thruster ports 46*b* and 18, the thruster ports 46*b* and 18 may be able to move the cuttings by about a given distance. The thruster ports 46*b* and 18 may be spaced apart along the length of the hose 11 with this given distance in mind such that each set of thruster ports 46*b* and 18 is assigned the task of moving the cuttings upstream by this given distance until the cuttings are removed from the well bore. For example, the hose 11 may be about 90 feet long and the thruster ports 46*b* and 18** may be spaced apart by equal intervals of 15 feet. Other lengths are possible, as well.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A flexible hose comprising:

a forward end and a rearward end, said rearward end configured to be in fluid communication with a source of high pressure drilling fluid;

a plurality of thruster ports located upstream of said forward end, said plurality of thruster ports configured to emit drilling fluid in a substantially rearward direction; and a plurality of shut-off valves configured to shut off flow of drilling fluid downstream, at least one of said shut-off valves located between different thruster ports.

2. The flexible hose of claim 1, further comprising a nozzle blaster located at said forward end and comprising a set of nozzle holes, said nozzle holes configured to emit drilling fluid in a substantially forward direction.

3. The flexible hose of claim 1, the thruster port comprising a shutter configured to adjust said thruster port between an open state and a closed state.

4. The flexible hose of claim 3, wherein said hose includes at least two hose sections and a thruster coupling located therebetween.

5. The flexible hose of claim 3, wherein the plurality of thruster ports are arranged as sets of thruster ports, each set of said thruster ports spaced along a length of said hose.

6. The flexible hose of claim 5, wherein said sets of said thruster ports are equally spaced apart.

7. The flexible hose of claim 5, wherein each of said shut-off valves is located between adjacent sets of thruster ports.

8. The flexible hose of claim 1, wherein said shut-off valve is operated by a controller that is remotely located from said shut-off valve.

9. The flexible hose of claim 8, wherein said shut-off valve is operated by a remote control servo mechanism.

10. A flexible hose comprising:

a forward end and a rearward end, said rearward end configured to be in fluid communication with a source of high pressure drilling fluid;

a nozzle blaster located at said forward end of said hose and comprising a front portion and a rear portion, said front portion comprising a set of nozzle holes, said rear portion comprising a plurality of thruster ports, said nozzle holes configured to emit drilling fluid in a substantially forward direction, said thruster ports configured to emit drilling fluid in a substantially rearward direction; and a plurality shut-off valves located between said front portion and said rear portion and configured to shut off flow of drilling fluid downstream, at least one of said shut-off valves located between different thruster ports.

11. The flexible hose of claim 10, wherein said shut-off valve is integrated in said front portion upstream of said nozzle holes.

12. The flexible hose of claim 10, wherein said shut-off valve is integrated in said rear portion downstream of said thruster ports.

13. The flexible hose of claim 10, wherein said shut-off valve is operated by a controller that is remotely located from said shut-off valve.

14. A method of well drilling, comprising:

advancing a flexible hose through a well bore, said hose comprising a forward end and a rearward end, said rearward end configured to be in fluid communication with a source of high pressure drilling fluid, a plurality of thruster ports located upstream of said forward end and configured to emit drilling fluid in a substantially rearward direction, and a plurality of shut-off valves located between said forward end and said thruster port, at least one shut-off valve being located between different thruster ports;

closing said shut-off valve to prevent drilling fluid from flowing downstream of said shut-off valve; and opening said shut-off valve to allow drilling fluid to flow downstream.

15. The method of claim 14, said hose further comprising a nozzle blaster located at said forward end of said hose and comprising a set of nozzle holes, said nozzle holes configured to emit drilling fluid in a substantially forward direction so as to cut through earth strata.

16. The method of claim 14, wherein the plurality of thruster ports are arranged as sets of thruster ports.

17. A method of well drilling, comprising:

advancing a flexible hose through a well bore, said hose comprising a forward end and a rearward end, said rearward end configured to be in fluid communication with a source of high pressure drilling fluid, a plurality of thruster ports located upstream of said forward end and configured to emit drilling fluid in a substantially rearward direction, each thruster port comprising a shutter configured to adjust said thruster port between an open state and a closed state, a shut-off valve located between said forward end and said rearward end, said hose further comprising a nozzle blaster located at said forward end of said hose and comprising a set of nozzle holes, said nozzle holes configured to emit drilling fluid in a substantially forward direction so as to cut through earth strata;

cutting through earth strata using said nozzle holes with said shutters in a closed state;

closing said shut-off valve to prevent drilling fluid from flowing downstream of said shut-off valve; and opening said shutters in a sequential order to allow drilling fluid to said thruster ports to move cut earth toward said rearward end.

18. The method of claim 17, wherein the plurality of thruster ports are arranged as sets of thruster ports, each set of said thruster ports spaced along a length of said hose, the sequential order is toward the rearward end, and only one set of said thruster ports being open at a time.

19. The method of claim 18, said plurality of sets of said thruster ports being equally spaced apart along a length of said hose.

20. The method of claim 17, further comprising the step of:

advancing said flexible hose further into a well bore after cut earth is moved out of a well bore.

* * * * *

UNITED STATES PATENT AND TRADEMARK OFFICE

CERTIFICATE OF CORRECTION

PATENT NO. : 8,186,459 B1
APPLICATION NO. : 12/488709
DATED : May 29, 2012
INVENTOR(S) : Henry B. Mazorow It is certified that error appears in the above-identified patent and that said Letters Patent is hereby corrected as shown below:

At Col. 5, Line 63 replace "angle 8" with "angle θ".

At Col. 5, line 64 replace "Angle 8" with "Angle θ".

Signed and Sealed this
Seventh Day of August, 2012

David J. Kappos

David J. Kappos
*Director of the United States Patent and Trademark Office*